US010510501B2

(12) United States Patent
Kubes

(10) Patent No.: US 10,510,501 B2
(45) Date of Patent: Dec. 17, 2019

(54) ROTARY KNOB CONTROLLER

(71) Applicant: Danfoss Power Solutions, Inc., Ames, IA (US)

(72) Inventor: Joseph John Kubes, Rosemount, MN (US)

(73) Assignee: DANFOSS POWER SOLUTIONS INC., Ames, IA (US)

( * ) Notice: Subject to any disclaimer, the term of this patent is extended or adjusted under 35 U.S.C. 154(b) by 359 days.

(21) Appl. No.: 15/491,344

(22) Filed: Apr. 19, 2017

(65) Prior Publication Data

US 2018/0308649 A1 Oct. 25, 2018

(51) Int. Cl.

| | |
|---|---|
| ***H01H 36/02*** | (2006.01) |
| ***G05G 1/08*** | (2006.01) |
| ***G05G 5/03*** | (2008.04) |
| ***G05G 13/02*** | (2006.01) |
| ***H01H 13/10*** | (2006.01) |
| ***H01H 13/14*** | (2006.01) |
| ***H01H 89/00*** | (2006.01) |
| *G05G 9/047* | (2006.01) |

(52) U.S. Cl.

CPC ..... *H01H 36/02* (2013.01); *G05G 1/08* (2013.01); *G05G 5/03* (2013.01); *G05G 13/02* (2013.01); *H01H 13/10* (2013.01); *H01H 13/14* (2013.01); *H01H 89/00* (2013.01); *G05G 2009/04755* (2013.01)

(58) Field of Classification Search

CPC ..... H01H 36/00–02; G05G 2009/04755

See application file for complete search history.

(56) References Cited

U.S. PATENT DOCUMENTS

| | | | | |
|---|---|---|---|---|
| 5,867,082 | A * | 2/1999 | Van Zeeland | G01D 5/06 200/521 |
| 2007/0194219 | A1 | 8/2007 | Shaw et al. | |
| 2013/0206551 | A1 | 8/2013 | Kosaka | |
| 2013/0220779 | A1 | 8/2013 | Kerner et al. | |
| 2016/0062461 | A1 | 3/2016 | Dooley et al. | |
| 2016/0077543 | A1 | 3/2016 | Conro et al. | |
| 2016/0118207 | A1 | 4/2016 | Kwon et al. | |
| 2016/0139695 | A1 | 5/2016 | Chase et al. | |

FOREIGN PATENT DOCUMENTS

| | | | |
|---|---|---|---|
| CN | 1685295 | A | 10/2005 |
| CN | 1822274 | A | 8/2006 |
| CN | 1841276 | A | 10/2006 |

(Continued)

OTHER PUBLICATIONS

European Search Report for Serial No. EP 18 16 0360 dated Sep. 21, 2018.

*Primary Examiner* — Ramon M Barrera

(74) *Attorney, Agent, or Firm* — McCormick, Paulding & Huber LLP

(57) ABSTRACT

According to the present disclosure, a controller includes a base and a continuous sealing layer connected to the base forming an environmentally sealed compartment between the base and a lower surface of the continuous sealing layer. A circuit board is positioned within the compartment, and a rotary knob encoder is positioned on an upper surface of the continuous sealing layer. Movement of the rotary knob encoder is detectable by the circuit board through the continuous sealing layer.

17 Claims, 6 Drawing Sheets

(56) References Cited

FOREIGN PATENT DOCUMENTS

| | | | |
|---|---|---|---|
| CN | 101005280 | A | 7/2007 |
| CN | 101825913 | A | 9/2010 |
| CN | 101886931 | A | 11/2010 |
| CN | 102709096 | A | 10/2012 |
| CN | 103745866 | A | 4/2014 |
| CN | 104319149 | A | 1/2015 |
| CN | 204102772 | U | 1/2015 |
| CN | 206293347 | U | 6/2017 |
| DE | 19922638 | A1 | 11/2000 |
| DE | 202004006783 | U1 | 10/2004 |
| DE | 102008057993 | B3 | 1/2010 |
| DE | 102010032784 | A1 | 2/2012 |
| EP | 3015946 | A2 | 5/2016 |
| KR | 1020090056463 | A | 6/2009 |
| WO | 2004019150 | A1 | 3/2004 |
| WO | 2010109753 | A1 | 9/2010 |

* cited by examiner

ROTARY KNOB CONTROLLER

TECHNICAL FIELD

The present disclosure relates to controllers and, more particularly, to controllers including rotary knobs.

BACKGROUND

Controllers having various user interfaces, including touch screens, push buttons, joysticks, rotary knobs and the like, provide control signals for controlling associated devices and are implemented in many every-day products and vehicles, such as automobiles, industrial power equipment and the like. Many of these products, vehicles in particular, employ a Controller Area Network (CAN or CAN bus), which is a network that allows microcontrollers and connected devices to communicate with each other in applications without a host computer, so that the various subsystems of the product or vehicle may communication with one another without a centralize processing unit. One or more controllers may be connected to such a CAN to control the various subsystems of the product or vehicle connected thereto.

SUMMARY

According to the present disclosure, a controller may comprise a base and a continuous sealing layer connected to the base to form an environmentally sealed compartment between the base and a lower surface of the continuous sealing layer. A circuit board is positioned within the compartment, and a ring-shaped rotary knob encoder is positioned on an upper surface of the continuous sealing layer. Movement of the rotary knob encoder is detectable by the circuit board through the continuous sealing layer.

According to the present disclosure, a controller may also comprise a base and a continuous sealing layer connected to a periphery of the base to form a compartment between the base and a lower surface of the continuous sealing layer. A circuit board is positioned within the compartment, and a rotary knob encoder is positioned on an upper surface of the continuous sealing layer. Movement of the rotary knob encoder is detectable through the continuous sealing layer.

According to the present disclosure, a controller may comprise a base and a continuous sealing layer connected to a periphery of the base to form an environmentally sealed compartment between the base and a lower surface of the continuous sealing layer. The continuous sealing layer may comprise a pedestal support formed in an upper surface of the continuous sealing layer. The pedestal support may comprise a cylindrical shaped body and may include semi-cylindrical accommodations formed in an outer surface thereof. The controller may include a plurality of cylindrical pins disposed within the semi-cylindrical accommodations. A ring-shaped rotary knob encoder is positioned about the outer surface of the pedestal support, the ring-shaped rotary knob encoder including an inner surface engaging the cylindrical pins and comprising a plurality of detents. Magnets are disposed within the ring-shaped rotary knob encoder at a lower rim thereof, the magnets associated with detents of the plurality of detents. A circuit board is positioned within the compartment and comprises at least two Hall switches positioned under the rotary knob encoder. The at least two Hall switches are configured to change states when in proximity to the magnets as the rotary knob encoder rotates to detect rotation of the rotary knob encoder. The circuit board may be configured to generate a control signal indicative of both the direction and distance of rotation of the rotary knob encoder.

These and other objects, features and advantages of the present disclosure will become apparent in light of the detailed description of embodiments thereof, as illustrated in the accompanying drawings.

DETAILED DESCRIPTION

Before the various embodiments are described in further detail, it is to be understood that the invention is not limited to the particular embodiments described. It will be understood by one of ordinary skill in the art that the controller and systems described herein may be adapted and modified as is appropriate for the application being addressed and that the controller and systems described herein may be employed in other suitable applications, and that such other additions and modifications will not depart from the scope thereof.

Figure 1:
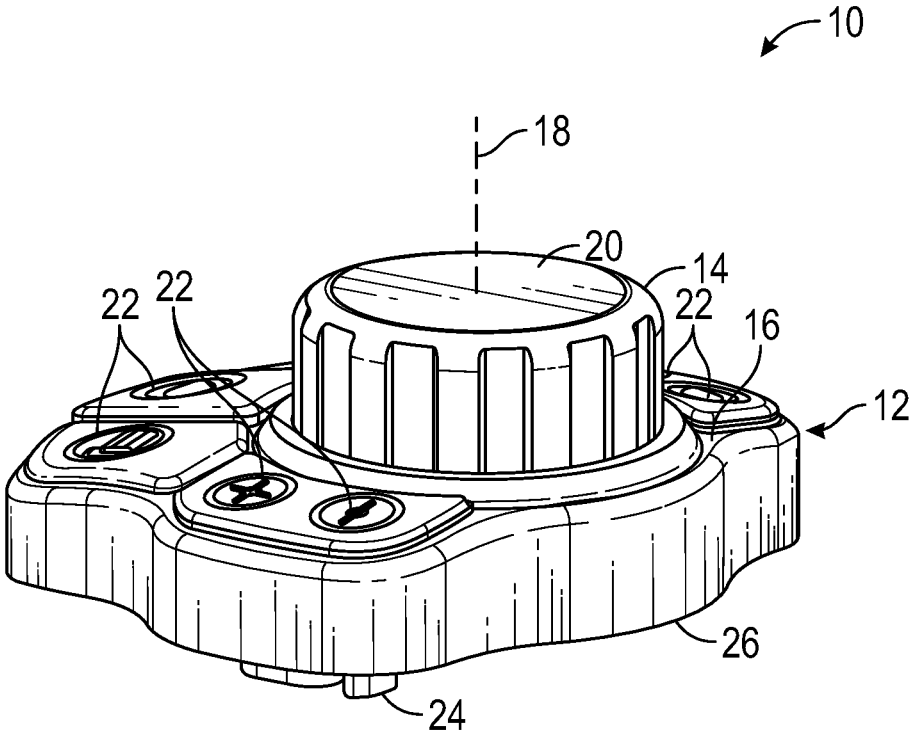
FIG. 1 is a right side perspective view of a controller according to the present disclosure.

Referring to FIG. 1, a controller 10 according to the present disclosure is shown. The controller 10 includes a housing 12 with a rotary knob encoder 14 disposed on an upper surface 16 of the housing 12 and rotatable about a central axis 18. The controller 10 may also include a central push button 20 disposed within the rotary knob encoder 14 and one or more additional push buttons 22 positioned about the upper surface 16 of the housing 12 proximate to the rotary knob encoder 14. A connection port 24 extends outward from a lower surface 26 of the housing 12 to facilitate connection of the controller 10 to a Controller Area Network (CAN or CAN bus) or other similar network so that the controller 10 may control the various subsystems, microprocessors, and/or devices connected to the CAN or other similar network using CAN or other communication protocols known in the art.

Figure 2:
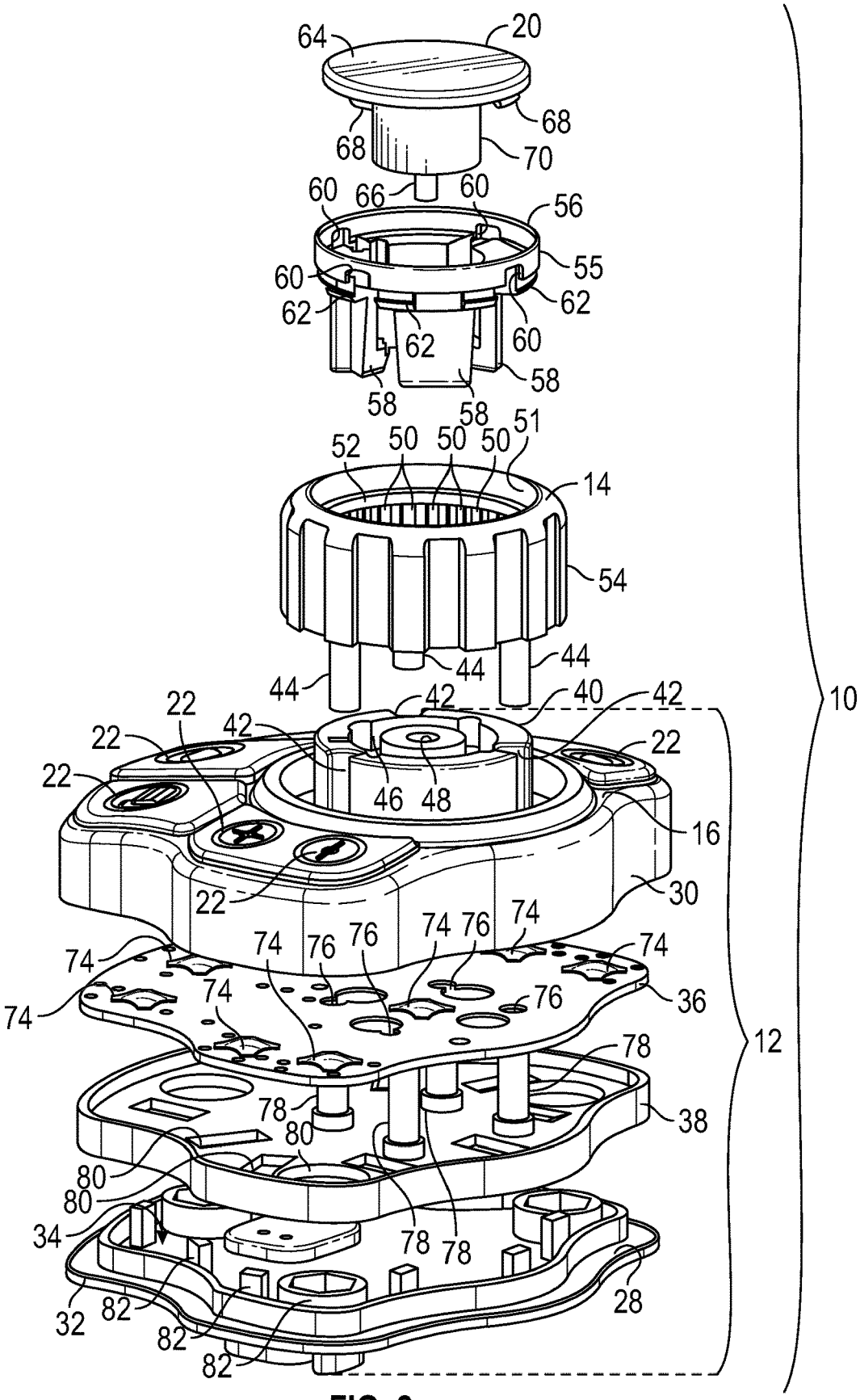
FIG. 2 is an exploded perspective view of the controller of FIG. 1.
Figure 3:
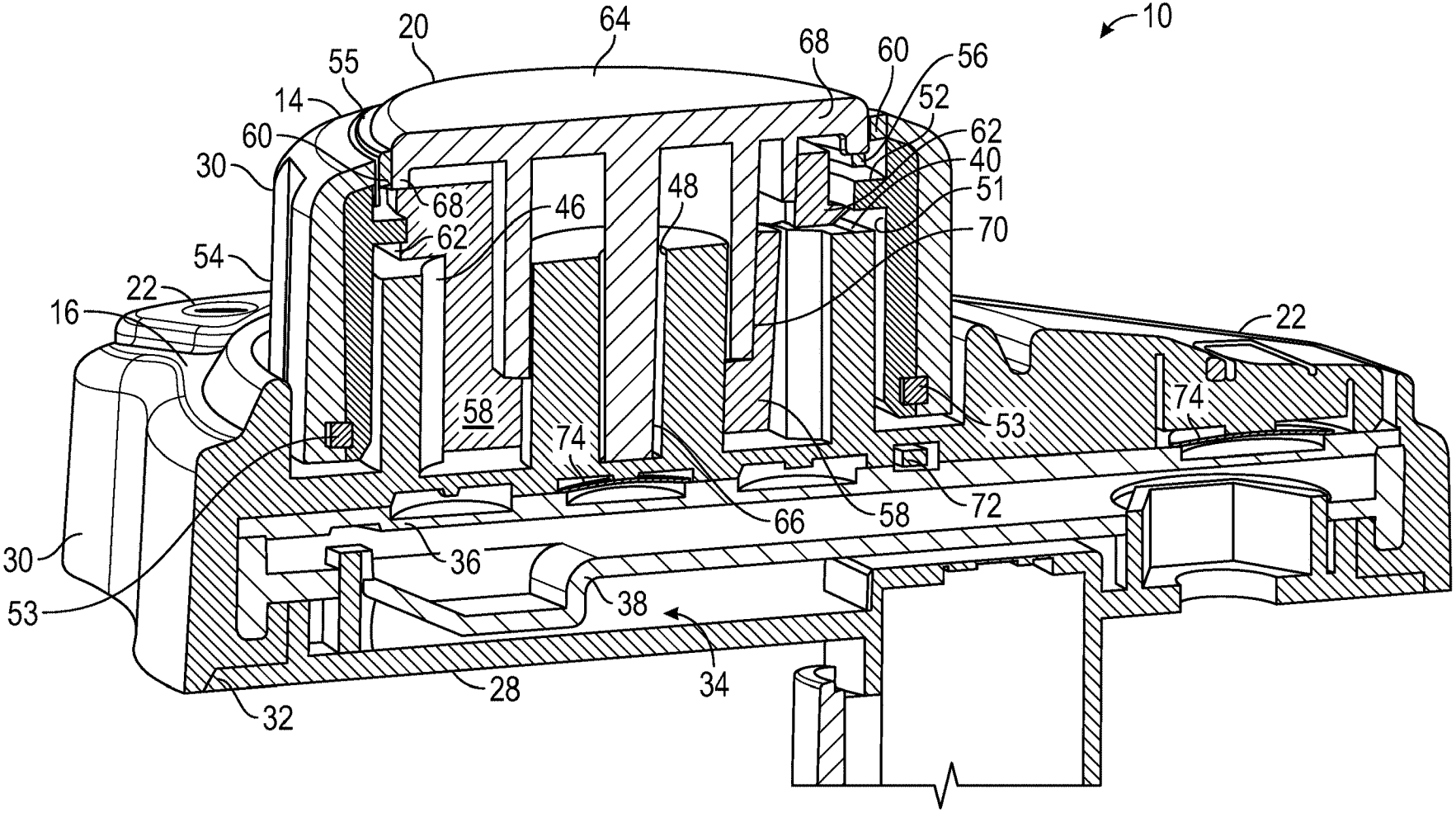
FIG. 3 is left side cross-sectional view of the controller of FIG. 1.

Referring to FIGS. 2 and 3, the housing 12 includes a base 28 and a sealing layer 30 positioned over the base 28. The sealing layer 30 is connected to the base 28 along the entire periphery 32 of the base 28 to form a compartment 34 between an upper surface of the base 28 and a lower surface of the sealing layer 30. The base 28 is formed from a hard plastic material such as nylon, a polycarbonate-acrylonitrile butadiene styrene (PC-ABS) blend or another similar material. The sealing layer 30 is a continuous layer made from silicone rubber or a similar material, without any openings of breaks therethough, thereby completely sealing the compartment 34 from the exterior of the controller 10.

A circuit board 36, such as a printed circuit board of the like, is disposed within the compartment 34 and is configured to receive user input through the rotary knob encoder 14, the central push button 20 and/or the one or more additional push buttons 22 as will be discussed in greater detail below. A support 38 may also be disposed within the compartment 34 to position the circuit board 36 within the compartment 34 and to provide support to the sealing layer 30 as discussed below.

The sealing layer 30 includes a pedestal support 40 formed in upper surface 16 that extends upward into the rotary knob encoder 14, and the one or more additional push buttons 22 formed in the upper surface 16 around the pedestal support 40. As seen in FIG. 2, the pedestal support 40 includes a plurality of semi-cylindrical indentations 42 formed in its outer surface and cylindrical pins 44 are disposed within the semi-cylindrical indentations 42. The cylindrical pins 44 may be formed from stainless steel or another similar rigid and low friction material. As seen in FIG. 2, the exemplary controller 10 of the present disclosure includes three semi-cylindrical indentations 42 and three corresponding cylindrical pins 44 positioned equidistantly about the pedestal support 40. However, one skilled in the art will appreciate that different numbers of semi-cylindrical indentations 42 and corresponding cylindrical pins 44 may be provided to change the rotational feel and reaction of the rotary knob encoder 14. The pedestal support also includes a recessed securing channel 46 and a recessed button cavity 48.

As shown in FIG. 2, the rotary knob encoder 14 has a ring shape with a plurality of detents 50 formed about an inner surface 51 of the ring shape and extending from a lower end thereof to a retaining ring 52 formed in the inner surface proximate to an upper end of the rotary knob encoder 14. The rotary knob encoder 14 includes a plurality of magnets 53, two of which are shown in FIG. 3, housed therein at its lower end. The magnets 53 are equally spaced apart about the circumference of the rotary knob encoder 14 at a desired magnet-to-detent ratio. For example, the rotary knob encoder 14 may include thirty-two (32) detents 50 formed about inner surface 51 and eight (8) magnets 53 positioned about its lower end, such that there is one magnet 53 for every four detents 50, which may allow each rotational movement of the rotary knob encoder 14 (i.e. from one detent to an immediately adjacent detent) and a direction of rotation to be detected by the controller 10, as discussed below. Although an exemplary magnet-to-detent ratio of 1:4 is discussed herein, those skilled in the art will readily understand that various other magnet-to-detent ratios could be employed depending upon a number of sensors used, as discussed below, a desired sensitivity of the controller 10, or other similar design considerations. The rotary knob encoder 14 is positioned about the pedestal support 40 with the cylindrical pins 44 engaging detents of the plurality of detents 50 of the rotary knob encoder 14. The rotary knob encoder 14 is also formed from a hard plastic material such as nylon, a PC-ABS blend or another similar material. An exterior surface 54 of the rotary knob encoder 14 may be textured to facilitate rotation of the rotary knob encoder 14 about the central axis 18, shown in FIG. 1, by a user.

A retention cap 55 includes an upper ring 56 and gripping legs 58 that extend downward from the upper ring 56. The gripping legs 58 extend downward into the recessed securing channel 46 and dig into a side of the securing channel 46 to frictionally secure the retention cap 55 to the pedestal support 40 of the sealing layer 30. One or more of the gripping legs 58 may optionally include an alignment tab 59, shown in FIG. 4, that engages a corresponding recess formed in the pedestal support 40 to ensure proper positioning of the retention cap 55. The upper ring 56 includes a plurality of locking recesses 60 formed therein and a plurality of locking tabs 62 extending downward therefrom.

The retention cap 55 passes through the central opening of the ring-shaped rotary knob encoder 14 when installed to secure the retention cap 55 to the pedestal support 40. The locking tabs 62 engage the retaining ring 52 of the rotary knob encoder 14 on the lower surface of the retaining ring 52 and the upper ring 56 of the retention cap 55 engages the upper surface of the retaining ring 52. Thus, the locking tabs 62 and the upper ring 56 secure the retaining ring 52 of the rotary knob encoder 14 between the upper ring 56 and locking tabs 62 to retain the rotary knob encoder 14 on the pedestal support 40.

The central push button 20 includes a circular contact portion 64 adapted to fit within the upper ring 56 of the retention cap 55 and an actuation extension 66 extending downward from an underside of the circular contact portion 64 into the button cavity 48 of the pedestal support 40 to the bottom thereof. A plurality of button securing tabs 68 are also formed on an underside of the circular contact portion 64, the plurality of button securing tabs 68 engaging the locking recesses 60 of the upper ring 56 to secure the central push button 20 to the pedestal support 40 and to properly position the central push button 20 relative to the rotary knob encoder 14. The central push button 20 may also include an alignment guide 70 that extends downward from an underside of the circular contact portion 64 into the recessed securing channel 46 and is configured to slide along an inner surface of the recessed securing channel 46.

As discussed above, the circuit board 36 and support 38 are disposed within the compartment 34. The circuit board 36 includes at least two Hall switches 72, shown in FIG. 3, spaced apart from one another and positioned on the circuit board 36 underneath the ring-shaped rotary knob encoder 14. Providing at least two Hall switches 72 for a rotary knob encoder 14 with a 1:4 magnet-to-detent ratio allows the controller 10 to detect each rotational movement of the rotary knob encoder 14 (i.e. from one detent to an immediately adjacent detent) and the direction of rotation. The circuit board also includes a plurality of dome switches 74, with one dome switch 74 being located on the circuit board 36 under the button cavity 48 of the pedestal support 40 and the other dome switches 74 being located on the circuit board 36 under the one or more additional push buttons 22 formed in the sealing layer 30. The circuit board 36 may also include alignment holes 76.

Figure 4:
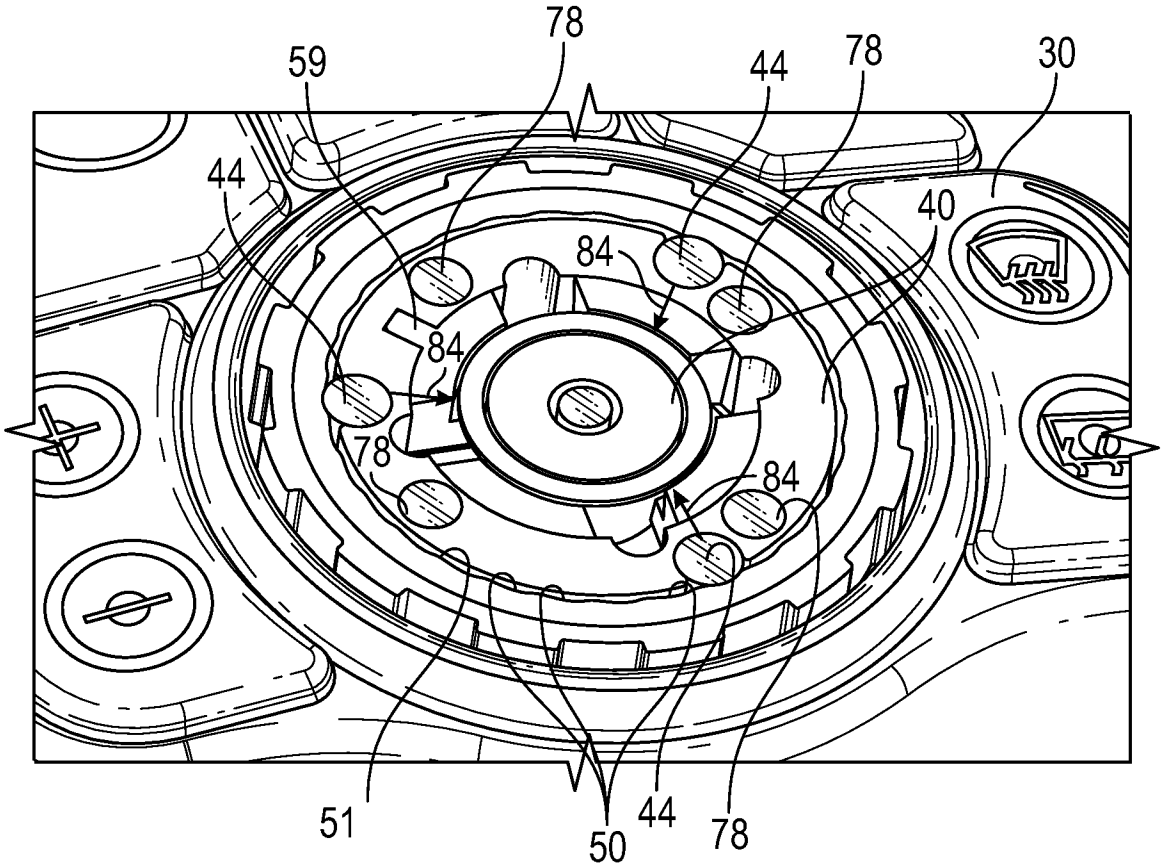
FIG. 4 is a top cross-sectional view of the controller of FIG. 1.

The support 38 includes support posts 78 that pass through the alignment holes 76 of the circuit board 36 to ensure proper alignment of the circuit board 36 relative to the support 38. As seen in FIG. 4, the support posts 78 extend into the pedestal support 40 of the sealing layer 30 to provide structural support to the pedestal support 40. The support 38 may also include one or more alignment features 80 that engage corresponding alignment features 82 on the base 28 to ensure proper alignment of the support 38 and, thus, the circuit board 36 relative to the base 28 and sealing layer 30.

In operation, a user of the controller 10 actuates one or more of the rotary knob encoder 14, the central push button 20 and/or the one or more additional push buttons 22 to generate control signals that are transmitted over the CAN or other similar network to control the various subsystems, microprocessors, and/or devices connected to the network. Referring to FIG. 3, when a user engages the one or more additional push buttons 22, the elasticity of the sealing layer 30, allows the push button 22 that has been engaged to actuate the dome switch 74 located beneath the push button 22. Similarly, when the user engages the central push button 20, the actuation extension 66 pushes into the sealing layer 30 at the bottom of the button cavity 48 and, due to the elasticity of the sealing layer 30, actuates the dome switch 74 located beneath the button cavity 48. Actuation of the dome switches 74 through the central push button 20 and/or the one or more additional push buttons 22 generates control signals that are transmitted over the CAN or other similar network. These control signals and, therefore, the central push button 20 and the one or more additional push buttons 22 may be programmed to control any of the various subsystems, microprocessors, and/or devices connected to the network. For example, when the controller 10 is implemented in a vehicle, one of the buttons, such as the central push button 20, may be programmed as an ENTER button for selecting a highlighted menu item. Other buttons, such as the one or more additional push buttons 22, may be set to control various vehicle subsystems, such as, lighting, including interior and/or exterior lights, windshield defrosters, audio systems and/or volume control, climate control systems, and/or any other similar vehicle subsystem.

Referring to FIG. 4, the rotary knob encoder 14 is rotatable about the central axis 18, shown in FIG. 1, in both the clockwise and counter-clockwise directions. As the rotary knob encoder 14 rotates, the elasticity of the sealing layer 30 and, thus, the pedestal support 40, which is part of the sealing layer 30, allows the pins 44 to exit the detents 50 and to be pushed in the radial direction 84 toward the central axis 18, shown in FIG. 1, by the inner surface 51 of the rotary knob encoder 14 until the adjacent detent 50 is reached. Thus, the elasticity provided by the sealing layer 30 allows the rotary knob encoder 14 to rotate from detent 50 to detent 50 by pushing the pins in the radial direction 84.

Referring to FIGS. 5A-5D, a sequence of single detent rotations of the rotary knob encoder 14 about the pedestal support 40 in a clockwise direction 86 is shown. As the rotary knob encoder 14 rotates from one position to the next, the magnets 53 disposed in the lower rim of the rotary knob encoder 14 come into and out of proximity with the two Hall switches 72 located on the circuit board 36 beneath the rotary knob encoder 14, thereby causing the Hall switches 72 to cycle between ON/OFF (LOW/HIGH) signal states as the magnets 53 pass into and out of detection zones 87 of the Hall switches 72.

In the exemplary rotary knob encoder 14, with a 1:4 magnet-to-detent ratio, the at least two Hall switch 72 may be positioned relative to the magnets 53 as shown in FIGS. 5A-5D so that each Hall switch 72 cycles between two consecutive ON states and two consecutive OFF states as the rotary knob encoder 14 rotates, with the ON states being positions of the rotary knob encoder 14 in which a magnet 53 is within the detection zone 87 of the Hall switch 72. Additionally, the Hall switches 72 may be positioned out of phase with one another so that, using quadrature amplitude modulation of the signals from the Hall switches 72, the controller 10 determines both the direction (i.e. clockwise or counter-clockwise) and the distance (i.e. the number of detents) that the rotary knob encoder 14 has turned based on the signal states from the Hall switches 72. Specifically, in quadrature amplitude modulation, the signalling of a first Hall switch 88 of the at least two Hall switches 72 is out of phase with the signalling of a second Hall switch 90 of the at least two Hall switches 72 so that, as seen in the exemplary Table 1 below, the direction that the rotary knob encoder 14 turns may be determined based on the change in state of the two Hall switches 72. For example, as seen in Table 1, from an initial ON-ON state (i.e. SWITCH 88-SWITCH 90) at the starting position shown in FIG. 5A, where both the first Hall switch 88 and second Hall switch 90 have a magnet within the detection zone 87, the controller 10 may determine if the rotary knob encoder 14 is rotated clockwise or counter-clockwise depending upon whether the subsequent rotated switch state is OFF-ON or ON-OFF, respectively.

Figure 5A:
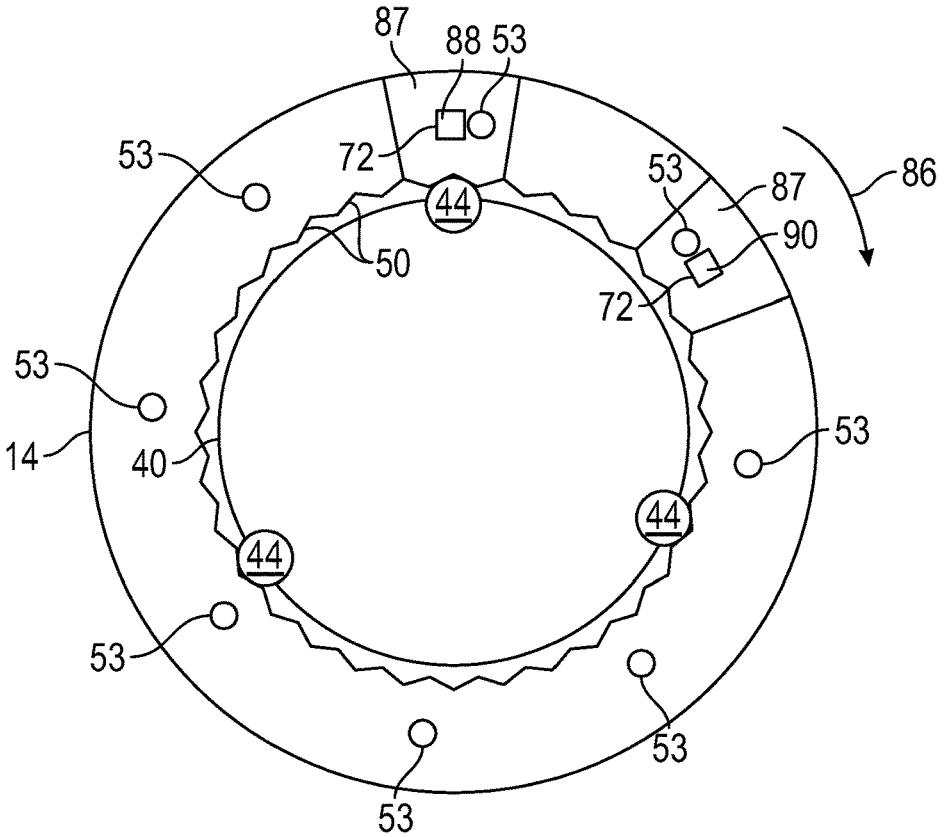
FIGS. 5A-5D show a schematic illustration of a sequence of rotations of a rotary knob encoder of the controller of FIG. 1.
Figure 5B:
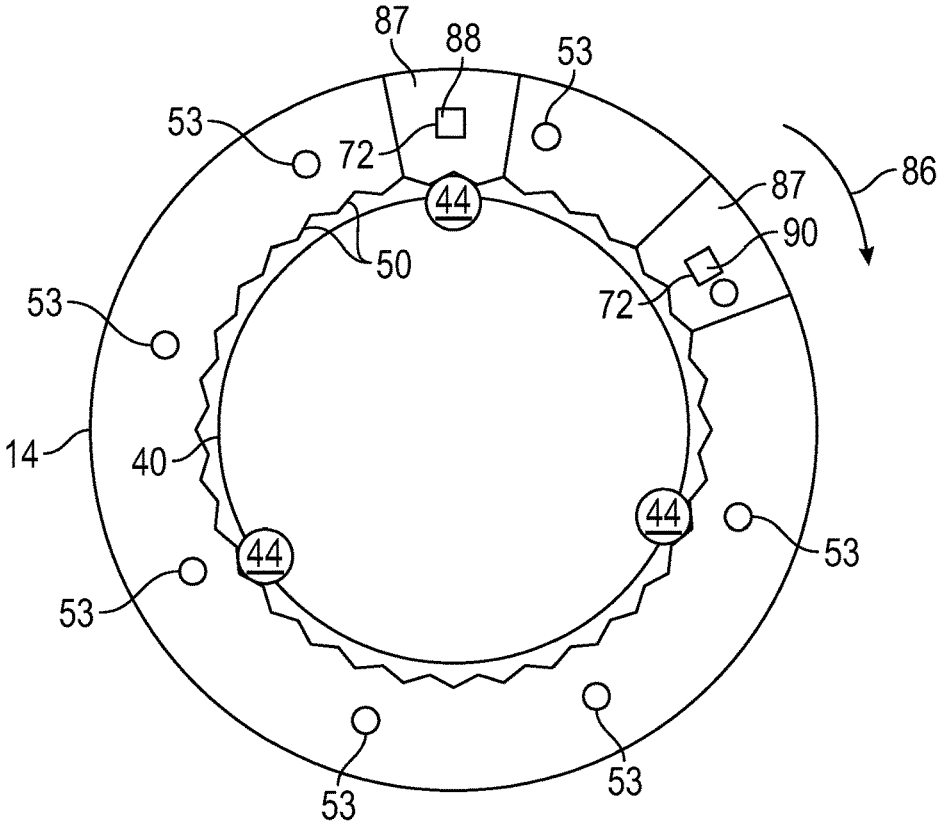
Figure 5C:
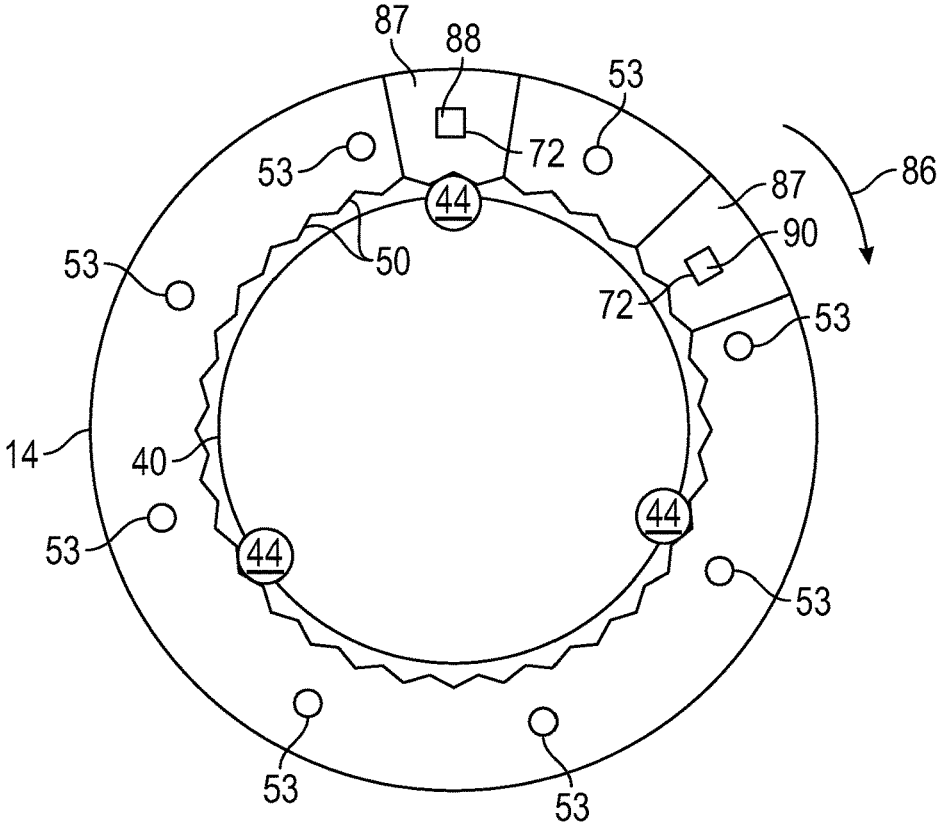
Figure 5D:
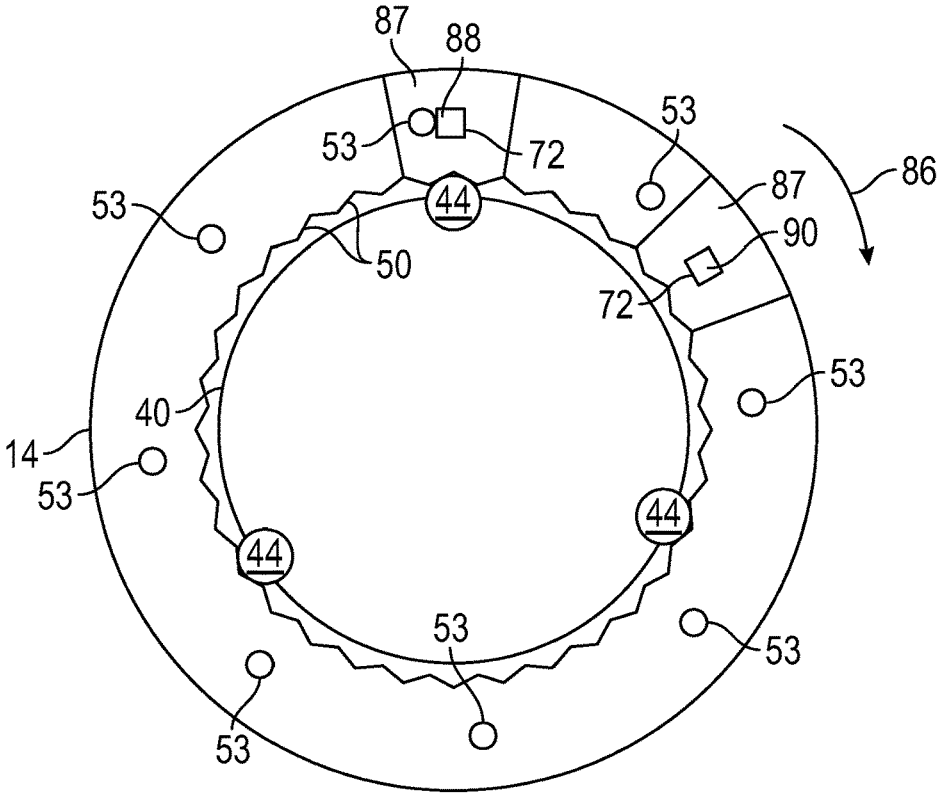

For instance, rotating the rotary knob encoder 14 in the clockwise direction 86 one detent from the position shown in FIG. 5A to the position shown in FIG. 5B results in a signal reading change from ON-ON to OFF-ON because, as seen in FIG. 5B, only the second Hall switch 90 has a magnet within detection zone 87. If the rotary knob encoder 14 is then rotated one additional detent in the clockwise direction 86 to the position shown in FIG. 5C, the signal reading changes to OFF-OFF since neither the first Hall switch 88 nor the second Hall switch 90 has a magnet within detection zone 87. An additional one-detent rotation in the clockwise direction 86 from the position shown in FIG. 5C to the position shown in FIG. 5D results in a signal change to an ON-OFF state since a magnet has moved into the detection zone 87 of the first Hall switch 88, while the second Hall switch 90 is still without a magnet in its detection zone 87. This pattern then repeats with additional rotations in the clockwise direction 86, as seen in Table 1 below, since an additional one detent rotation of the rotary knob encoder 14 in the clockwise direction 86 from the position shown in FIG. 5D returns the rotary knob encoder 14 to the position shown in FIG. 5A.

Similarly, as seen in Table 1 below, counter-clockwise rotation of the rotary knob encoder 14 may be detected and tracked by the controller 10 in the same manner as clockwise rotation through the signals from the first Hall switch 88 and second Hall switch 90. For example, a one detent counter-clockwise rotation of the rotary knob encoder 14 from the starting position shown in FIG. 5A, moves the rotary knob encoder 14 to the position shown in FIG. 5D and results in an ON-OFF signal state since a magnet 53 remains in the detection zone 87 of the first Hall switch 88, while the detection zone 87 of the second Hall switch 90 has no magnet 53 therein. The controller 10 may then determine additional counter-clockwise and/or clockwise rotations of the rotary knob encoder 14 in the same manner described above.

In addition to determining the direction of rotation of the rotary knob encoder 14, the controller 10 also determines the distance the rotary knob encoder 14 rotates, i.e. the number of detents rotated, by counting the number of signal changes of the at least two Hall switches 72. For instance, in the exemplary controller 10 with a magnet-to-detent ratio of 1:4, the controller 10 may track each detent-to-detent rotation of the rotary knob encoder 14 in either the clockwise or counter-clockwise direction for each state change shown above in Table 1.

Thus, by tracking these state changes of the signals from the at least two Hall sensors 72, the controller 10 determines the distance (i.e. the number of detents) that the rotary knob encoder 14 rotates as well as the direction of rotation.

TABLE 1

Exemplary Rotary Knob Encoder Signal Processing

| | Detent Rotations | 1st Hall Switch 88 | 2nd Hall Switch 90 |
|---|---|---|---|
| Clockwise Direction | 8 | ON | ON |
| | 7 | ON | OFF |
| | 6 | OFF | OFF |
| | 5 | OFF | ON |
| | 4 | ON | ON |

TABLE 1-continued

| Exemplary Rotary Knob Encoder Signal Processing | | | |
|---|---|---|---|
| | Detent Rotations | 1st Hall Switch 88 | 2nd Hall Switch 90 |
| | 3 (FIG. 5D) | ON | OFF |
| | 2 (FIG. 5C) | OFF | OFF |
| | 1 (FIG. 5B) | OFF | ON |
| Starting Position (FIG. 5A) | | ON | ON |
| Counter- | 1 | ON | OFF |
| Clockwise | 2 | OFF | OFF |
| Direction | 3 | OFF | ON |
| | 4 | ON | ON |
| | 5 | ON | OFF |
| | 6 | OFF | OFF |
| | 7 | OFF | ON |
| | 8 | ON | ON |

Although the tracking of the rotary knob encoder 14 has been described in connection with a specific starting position for simplicity, it should be readily understood from the present disclosure that the controller 10 may determine the direction and distance of rotation in the same manner described above from any starting position of the rotary knob encoder 14.

As with the central push button 20 and the additional push buttons 22, control signals generated by the rotary knob encoder 14 are transmitted by the controller 10 over the CAN or other similar network to control the various subsystems, microprocessors, and/or devices connected to the network. The directional and distance control provided by the rotary knob encoder 14 make signals generated by the rotary knob encoder 14 ideal for controlling actions such as scrolling through menu items and/or lists displayed on a display screen or other similar actions. In such embodiments, the central push button 20 may be configured as an ENTER button so that a user may scroll to highlight a particular menu item displayed on a screen using the rotary knob encoder 14 and then select the highlighted menu item using the central push button 20. Although the control signalling provided by the rotary knob encoder 14 has been described in connection with scrolling through menu items for simplicity, the control signals provided by the rotary knob encoder 14 may be used in various other application such as for climate control settings, zooming, volume control settings, or any other similar applications where degree and directional control are desirable.

The sealing layer 30 is advantageously able to be formed as a single continuous layer without any openings or breaks therethrough because the elasticity of the sealing layer 30 provides a spring force on pins 44 that limit the detent-to-detent rotation of the rotary knob encoder 14 and because the controller 10 uses magnets 53 disposed in the rotary knob encoder 14 and Hall switches 72 disposed within the compartment 34 on the circuit board 36 to detect rotation of the rotary knob encoder 14 through the sealing layer 30.

Thus, the controller 10 of the present disclosure advantageously provides improved environmental sealing over conventional rotary knobs by including the continuous sealing layer 30 connected to the entire periphery of base 28 to form the compartment 34 housing the circuit board 36, without including any openings of breaks through the continuous sealing layer 30. This continuous sealing layer 30 advantageously prevents contaminants such as dust, liquid or the like from entering the compartment 34.

While various embodiments have been described in the present disclosure, it will be appreciated by those of ordinary skill in the art that modifications can be made to the various embodiments without departing from the spirit and scope of the invention as a whole. For instance, the controller 10 could be configured without the central push button 20, in which case the rotary knob encoder 14 described above could be replaced with a known rotary encoder that includes a chip on the circuit board located in the center of the knob, where the snap dome switch for the central push button 20 would have been positioned, that interacts with a magnet, divided in half, north pole and south pole, across the face of the magnet, disposed in the rotary knob, thereby still allowing the controller 10 to track movement of the rotary knob through the continuous sealing layer 30. Accordingly, the particular embodiments described in this specification are to be taken as merely illustrative and not limiting.

What is claimed is:

1. A controller comprising:

a base;

a continuous sealing layer connected to the base to form a compartment between the base and a lower surface of the continuous sealing layer;

a circuit board positioned within the compartment; and a ring-shaped rotary knob encoder positioned on an upper surface of the continuous sealing layer, movement of the rotary knob encoder being detectable by the circuit board through the continuous sealing layer;

wherein the continuous sealing layer is formed from silicon rubber; and wherein the continuous sealing layer includes a pedestal support formed in an upper surface that extends into a central opening through the ring-shaped rotary knob encoder.

2. The controller according to claim 1, wherein the pedestal support includes accommodations for a plurality of pins spaced apart about the pedestal support.

3. The controller according to claim 2, wherein the accommodations are semi-cylindrical indentations formed in an outer surface of the pedestal support; and wherein the pins are cylindrical pins.

4. The controller according to claim 3, wherein the ring-shaped rotary knob encoder includes an inner surface comprising a plurality of detents, each pin of the plurality of pins configured to engage a detent of the plurality of detents.

5. The controller according to claim 4, wherein the ring-shaped rotary knob encoder is rotatable around the pedestal support; and wherein the pedestal support provides a spring force acting on the pins as the pins pass between detents of the ring-shaped rotary knob encoder when the ring-shaped rotary knob encoder rotates.

6. The controller according to claim 4, wherein the ring-shaped rotary knob encoder includes a plurality of magnets disposed about a lower rim of the rotary knob encoder, each magnet of the plurality of magnets being associated with one or more detents of the plurality of detents; and wherein the circuit board includes at least two Hall switches configured to change states when in proximity to the magnets of the plurality of magnets as the rotary knob encoder rotates.

7. The controller according to claim 1, additionally comprising a central push button disposed within the ring-shaped rotary knob.

8. The controller according to claim 7, wherein the central push button includes an actuation extension arm configured to push a portion of the sealing layer to engage a switch disposed on the circuit board through the sealing layer when the central push button is actuated.

9. The controller according to claim 1, additionally comprising at least one additional push button formed in an upper surface of the sealing layer adjacent to the rotary knob encoder.

10. A controller comprising:

a base;

a continuous sealing layer connected to a periphery of the base to form a compartment between the base and a lower surface of the continuous sealing layer;

a circuit board positioned within the compartment; and a rotary knob encoder positioned on an upper surface of the continuous sealing layer, movement of the rotary knob encoder being detectable through the continuous sealing layer;

wherein the continuous sealing layer includes a pedestal support formed in an upper surface, the pedestal support extending into and supporting the rotary knob encoder through a plurality of pins spaced apart about the pedestal support.

11. The controller according to claim 10, wherein the rotary knob encoder includes an inner surface engaging the pins of the plurality of pins, the inner surface comprising a plurality of detents.

12. The controller according to claim 11, wherein the rotary knob encoder includes a plurality of magnets disposed about a lower rim of the rotary knob encoder and associated with detents of the plurality of detents.

13. The controller according to claim 12, wherein the circuit board includes at least two Hall switches configured to change states when in proximity to the magnets of the plurality of magnets as the rotary knob encoder rotates.

14. The controller according to claim 10, wherein the pedestal support includes accommodations formed in an outer surface thereof for accommodating the pins of the plurality of pins.

15. The controller according to claim 14, wherein the accommodations are semi-cylindrical indentations formed in an outer surface of the pedestal support; and wherein the pins are cylindrical pins.

16. The controller according to claim 10, additionally comprising a retention cap comprising an upper ring and gripping legs extending outward from the upper ring, the upper ring engaging a retaining ring formed on the rotary knob encoder and the gripping legs engaging the pedestal support to retain the rotary knob encoder on the pedestal support.

17. A controller comprising:

a base;

a continuous sealing layer connected to a periphery of the base to form an environmentally sealed compartment between the base and a lower surface of the continuous sealing layer, the continuous sealing layer comprising a pedestal support formed in an upper surface of the continuous sealing layer, the pedestal support comprising a cylindrical shaped body having semi-cylindrical accommodations formed in an outer surface thereof;

a plurality of cylindrical pins disposed within the semi-cylindrical accommodations;

a ring-shaped rotary knob encoder positioned about the outer surface of the pedestal support, the ring-shaped rotary knob encoder including:

an inner surface engaging the cylindrical pins of the plurality of cylindrical pins, the inner surface comprising a plurality of detents; and a plurality of magnets disposed within the ring-shaped rotary knob encoder at a lower rim thereof and associated with detents of the plurality of detents; and a circuit board positioned within the compartment, the circuit board comprising at least two Hall switches positioned under the rotary knob encoder and configured to change states when in proximity to the magnets of the plurality of magnets as the rotary knob encoder rotates to detect rotation of the rotary knob encoder;

wherein the circuit board is configured to generate a control signal indicative of the direction and distance of rotation of the rotary knob encoder.

* * * * *